US006181082B1

(12) United States Patent
Moisin

(10) Patent No.: US 6,181,082 B1
(45) Date of Patent: Jan. 30, 2001

(54) BALLAST POWER CONTROL CIRCUIT

(75) Inventor: Mihail S. Moisin, Brookline, MA (US)

(73) Assignee: Electro-Mag International, Inc., N. Scitutate, MA (US)

( * ) Notice: Under 35 U.S.C. 154(b), the term of this patent shall be extended for 0 days.

(21) Appl. No.: 09/173,140

(22) Filed: Oct. 15, 1998

(51) Int. Cl.[7] ..... H05B 37/02

(52) U.S. Cl. ..... 315/291; 315/209 R; 315/240; 315/241 R

(58) Field of Search ..... 315/209 R, 224, 315/307, 291, 209 CD, 276, DIG. 5, 219, 308, 297, 241 R, 225, 240

(56) References Cited

U.S. PATENT DOCUMENTS

| | | | |
|---|---|---|---|
| 3,808,481 | 4/1974 | Rippel | 318/139 |
| 4,115,729 | 9/1978 | Young et al. | 322/86 |
| 4,164,785 | 8/1979 | Young et al. | 363/50 |
| 4,270,164 | 5/1981 | Wyman et al. | 363/56 |
| 4,415,839 | 11/1983 | Lesea | 315/308 |

(List continued on next page.)

FOREIGN PATENT DOCUMENTS

| | | | |
|---|---|---|---|
| 3316402 | 11/1983 | (DE) . | |
| 4010435 | 10/1991 | (DE) . | |
| 4032664 | 4/1992 | (DE) . | |
| 296 04 904 U1 | 8/1996 | (DE) . | |
| 0 178 804 A2 | 4/1986 | (EP) . | |
| 0259646 | 3/1988 | (EP) . | |
| 0460641 | 12/1991 | (EP) . | |
| 0522266 | 1/1993 | (EP) . | |
| 2 669 499 | 11/1990 | (FR) . | |
| 2163576 | 2/1986 | (GB) . | |
| 2204455 | 11/1988 | (GB) . | |
| 63-002464 | 11/1988 | (JP) | H02H/9/08 |
| 9113530 | 9/1991 | (WO) . | |
| 9422209 | 9/1994 | (WO) . | |
| 9535646 | 12/1995 | (WO) . | |
| 9825441 | 6/1998 | (WO) . | |

OTHER PUBLICATIONS

Kazimierczuk, Marian et al. "Resonant Power Converters", (1995), A Wiley–Interscience Publication, pp. 332–333.

"Simple Dimming Circuit for Fluorescent Lamp", IBM Technical Disclosure Bulletin, vol. 34, No. 4A, Sep. 1, 1991, pp. 109–111, XP000210848.

Okude, A. et al., "Development of an Electronic Dimming Ballast for Fluorescent Lamps," *Journal of the Illuminating Engineering Society,* vol. 21, No. 1, 15–21 (Winter 1992).

International Search Report dated Apr. 19, 2000.

* cited by examiner

*Primary Examiner*—Don Wong
*Assistant Examiner*—Wilson Lee
(74) *Attorney, Agent, or Firm*—Nutter, McClennen & Fish, LLP

(57) ABSTRACT

A ballast circuit for energizing a lamp includes an inductive element coupled to an input terminal and a capacitive element coupled to the inductive element in parallel with the lamp. In one embodiment, the capacitive element includes a plurality of capacitors each of which is coupled in series with a switch to control the total capacitance provided by the capacitors. By controlling the total capacitance, the intensity of light emitted by the lamp can be selected. In another embodiment, a switching element is coupled across one of the capacitors for providing a selected capacitance to the circuit for controlling the lamp light intensity. In a further embodiment, a transformer has a first winding coupled in series with the capacitive element with the inductive impedance of the first winding being controlled via a second transformer winding coupled to a control circuit. In another embodiment, a ballast circuit includes a transformer for introducing a series current into the circuit for subsequent detection by a detection circuit. This arrangement can be used to send a data signal from one point in the circuit to another which can be used to determine a lamp fight intensity level.

23 Claims, 7 Drawing Sheets

U.S. PATENT DOCUMENTS 4,423,363 12/1983 Clark et al. ..... 318/375
4,480,298 10/1984 Fry ..... 363/28
4,489,373 12/1984 du Parc ..... 363/56
4,507,698 3/1985 Nilssen ..... 361/42
4,525,648 6/1985 De Bijl et al. ..... 315/224
4,559,479 12/1985 Munson ..... 315/239
4,572,988 2/1986 Handler et al. ..... 315/209 R
4,608,958 9/1986 Sakakibara et al. ..... 123/605
4,618,810 10/1986 Hagerman et al. ..... 318/803
4,624,334 11/1986 Kelledes et al. ..... 180/79.1
4,675,576 6/1987 Nilssen ..... 315/242
4,682,083 7/1987 Alley ..... 315/307
4,684,851 8/1987 Van Meurs ..... 315/224
4,712,045 12/1987 Van Meurs ..... 315/224
4,783,728 11/1988 Hoffman ..... 363/37
4,818,917 4/1989 Vest ..... 315/171
4,864,486 9/1989 Spreen ..... 363/126
4,866,586 9/1989 Suko ..... 363/5
4,870,327 9/1989 Jorgensen ..... 315/307
4,899,382 2/1990 Gartner ..... 379/413
4,900,989 * 2/1990 Suenaga et al. ..... 315/308
4,952,853 8/1990 Archer ..... 318/254
4,991,051 2/1991 Hung ..... 361/57
5,003,231 3/1991 Perper ..... 315/291
5,004,955 4/1991 Nilssen ..... 315/119
5,014,305 5/1991 Moisin ..... 379/402
5,027,032 6/1991 Nilssen ..... 315/103
5,052,039 9/1991 Moisin ..... 379/402
5,063,339 11/1991 Orii et al. ..... 318/696
5,081,401 1/1992 Moisin ..... 315/324
5,124,619 6/1992 Moisin et al. ..... 315/219
5,138,233 8/1992 Moisin et al. ..... 315/187
5,138,234 8/1992 Moisin ..... 315/209 R
5,138,236 8/1992 Bobel et al. ..... 315/209 R
5,144,195 9/1992 Konopka et al. ..... 315/94
5,148,087 9/1992 Moisin et al. ..... 315/291
5,173,643 12/1992 Sullivan et al. ..... 315/276
5,177,408 1/1993 Marques ..... 315/291
5,191,263 3/1993 Konopka ..... 315/209 R
5,216,332 6/1993 Nilssen ..... 315/224
5,220,247 6/1993 Moisin ..... 315/209 R
5,223,767 6/1993 Kulka ..... 315/209 R
5,256,939 10/1993 Nilssen ..... 315/244
5,291,382 3/1994 Cohen ..... 363/16
5,309,066 5/1994 Ditlevsen ..... 315/205
5,313,143 5/1994 Vila-Masot et al. ..... 315/209 R
5,315,533 5/1994 Stich et al. ..... 364/480
5,332,951 7/1994 Turner et al. ..... 315/209 R
5,334,912 8/1994 Counts ..... 315/119
5,381,076 * 1/1995 Nerone ..... 315/308
5,390,231 2/1995 Hung et al. ..... 379/2
5,399,943 3/1995 Chandrasekaran ..... 315/219
5,416,388 5/1995 Shackle ..... 315/219
5,432,817 7/1995 Hormel et al. ..... 375/257
5,434,477 7/1995 Crouse et al. ..... 315/209 R
5,434,480 7/1995 Bobel ..... 315/224
5,444,333 8/1995 Lau ..... 315/94
5,446,365 8/1995 Nomura et al. ..... 320/14
5,481,160 1/1996 Nilssen ..... 315/209 R
5,493,180 2/1996 Bezdon et al. ..... 315/91
5,504,398 4/1996 Rothenbuhler ..... 315/209 R
5,515,433 5/1996 Chen ..... 379/398
5,563,479 10/1996 Suzuki ..... 318/139
5,574,335 11/1996 Sun ..... 315/119
5,579,197 11/1996 Mengelt et al. ..... 361/93
5,583,402 12/1996 Moisin et al. ..... 315/307
5,589,742 * 12/1996 Ueda ..... 315/307
5,608,295 3/1997 Moisin ..... 315/247
5,608,595 3/1997 Gourab et al. ..... 361/79
5,638,266 6/1997 Horie et al. ..... 363/132
5,684,683 11/1997 Divan et al. ..... 33/65
5,686,799 11/1997 Moisin et al. ..... 315/307
5,691,606 11/1997 Moisin et al. ..... 315/307
5,694,006 * 12/1997 Konopka ..... 315/224
5,798,617 8/1998 Moisin ..... 315/247
5,821,699 10/1998 Moisin ..... 315/291
5,825,136 10/1998 Rudolph ..... 315/291
5,831,396 11/1998 Rudolph ..... 315/307
5,866,993 2/1999 Moisin ..... 315/307
5,973,437 * 10/1999 Gradzki et al. ..... 315/219

BALLAST POWER CONTROL CIRCUIT

FIELD OF THE INVENTION

The present invention relates to circuits for driving a load and more particularly to ballast circuits for energizing one or more lamps.

BACKGROUND OF THE INVENTION

As is known in the art, a light source or lamp generally refers to an electrically powered element which produces light having a predetermined color such is a white or a near white. Light sources may be provided, for example, as incandescent light sources, fluorescent light sources and high-intensity discharge (HID) light sources such as mercury vapor, metal halide, high-pressure sodium and low-pressure sodium light sources.

As is also known, fluorescent and HID light sources can be driven by a ballast. A ballast is a device which by means of inductance, capacitance or resistance, singly or in combination, limits a current provided to a light source such as a fluorescent or a high intensity discharge light source, for example. The ballast provides an amount of current required for proper lamp operation. Also, in some applications, the ballast may provide a required starting voltage and current. In the case of so-called rapid start lamps, the ballast heats a cathode of the lamp prior to providing a strike voltage to the lamp.

As is also known, a relatively common ballast is a so-called magnetic or inductive ballast. A magnetic ballast refers to any ballast which includes a magnetic element such as a laminated, iron core or an inductor. Magnetic ballasts are typically reliable and relatively inexpensive and drive lamps coupled thereto with a signal having a relatively low frequency.

FIG. 1 shows an exemplary prior art magnetic ballast 10 for energizing a lamp 12. The ballast 10 includes an inductive element or choke L and a capacitive element C which is coupled across first and second input terminals 14*a,b* of the ballast. The capacitive element C provides power factor correction for an AC input signal. In an exemplary embodiment, the choke has an impedance of about 1.5 Henrys and the capacitor C has a capacitance of about 3 microFarads.

The input terminals 14*a,b* are adapted for receiving the AC input signal, such as a 230 volt, 50 Hertz signal. The first input terminal 14*a* can be coupled to a so-called Phase (P) signal and the second input terminal 14*b* can be coupled to a so-called Neutral (N) signal. The lamp 12 includes first and second lamp filaments FL1,FL2 with a starter circuit 16 coupled in parallel with the lamp filaments. Upon initial application of the AC input signal, the starter circuit 16(, provides a short circuit so that current flows through the starter circuit thereby heating the lamp filaments FL1,FL2. After a time, the starter circuit 16 provides an open circuit as current flow through the lamp 12 is initiated. A voltage level of about 230 Volts is sufficient to strike the lamp 12 and cause current to flow between the filaments FL1,F12.

While such a circuit configuration may provide an adequate power factor, it is relatively inefficient and generates significant heat that must be dissipated. In addition, the circuit requires a starter circuit to initiate current flow through the lamp. Furthermore, the circuit is not readily adapted for providing a lamp dimming feature.

It would, therefore, be desirable to provide a ballast circuit that is efficient and allows the light intensity to be readily modified, i.e., dimming.

SUMMARY OF THE INVENTION

The present invention provides an efficient ballast circuit that includes a dimming feature for altering the intensity of light emitted by a lamp energized by the ballast. Although the invention is primarily shown and described as a ballast circuit, it will be appreciated that the invention has other applications as well, such as voltage regulation and electrical motors.

In one embodiment, a ballast circuit includes first and second input terminals for receiving an AC input signal which ultimately energizes a lamp. An inductive element or choke is coupled to the first input terminal and a capacitor is coupled between the inductive element and the second input terminal such that the capacitor and the lamp are connected in parallel. The inductive element and the capacitor are effective to generate a series resonance which can increase voltage at the lamp to a level above that of the input signal voltage. This arrangement allows a reduction in the size of the capacitor and increases efficiency as compared with conventional ballast circuits without sacrificing power factor correction advantages.

In another embodiment of a ballast circuit in accordance with the present invention, the circuit includes an inductive element and a plurality of capacitive elements coupled in parallel with the lamp. Each of the capacitive elements is coupled in series to a respective switch and each switch is controlled by a control circuit. A user interface is coupled to the control circuit for controlling the position of the switches. By controlling the switches based upon information from the user interface, a total capacitance provided by the parallel capacitors can be selected to achieve a desired intensity level for light emitted by the lamp.

In a further embodiment, a ballast circuit includes an inductive element and a plurality of capacitors coupled end to end in parallel with the lamp. Alternatively, the capacitors can be coupled in parallel with each other. At least one of the capacitors is coupled to a switching element for selectively shorting the capacitor. By controlling the duty cycle of the switching element, a predetermined capacitance level can be selected for setting light emitted by the lamp to a desired intensity level.

In still another embodiment, a ballast circuit includes an inductive element and a capacitor which is coupled in series with a first transformer winding such that the series-coupled capacitor and first winding are connected in parallel with the lamp. A second transformer winding, which is inductively coupled to the first winding, is coupled to a control circuit. The control circuit provides a signal to the second winding that is effective to cancel a predetermined amount of the flux generated by the first winding. In the case where the flux is substantially canceled, the first winding appears to the circuit as a relatively small DC resistance. By controlling the inductive impedance provided by the first winding, series resonance between the inductive element, the capacitor and the first winding can be manipulated to achieve a predetermined light intensity for the lamp.

In yet a still further embodiment, a ballast circuit has a series circuit path including a first input terminal, a first winding of a first transformer, a first inductive element, a first inductive detection element, a lamp, a second inductive detection element, and a second input terminal. A capacitor has one end coupled between the first inductive element and the first detection element and the other end coupled to the second input terminal. A second winding of the first transformer is coupled to a signal generator for providing a signal to the first transformer. A third inductive detection element, which is inductively coupled to the first and second detection elements, is coupled to a signal detector. In one embodiment, a detection circuit includes the inductive detection elements and the signal detector.

The signal generator, under the control of a user, generates a data signal on the second transformer winding that induces a corresponding signal on the first winding. The data signal generates a series resonance for current flowing through the first inductive element and the capacitor which is detected by the detection circuit. The information provided by the detected data signal can be used to control the power to the lamp to achieve a light intensity level selected by the user via the signal generator.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 2:
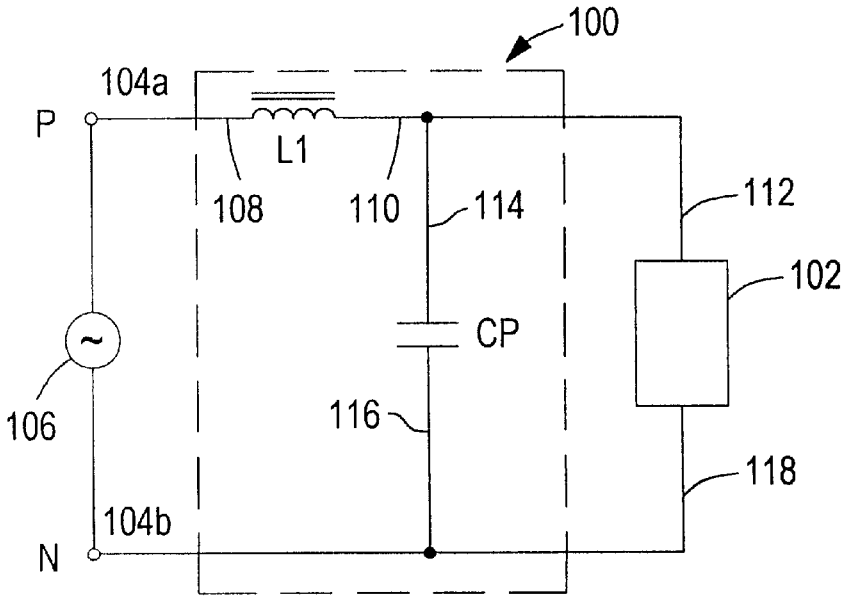
FIG. 2 is a circuit diagram of a ballast circuit in accordance with the present invention.

FIG. 2 shows a magnetic ballast circuit 100 for energizing a load 102, such as a fluorescent lamp. The ballast 100 has first and second input terminals 104*a,b* coupled to an AC power source 106. In one embodiment, the AC power source 106 provides a 230 Volt, 50 Hz signal to the ballast, such that the first input terminal 104*a* corresponds to a so-called Phase (P) signal and the second input terminal 104*b* corresponds to a so-called Neutral (N) signal.

The ballast further includes an inductive element L1 having a first terminal 108 coupled to the first input terminal (Phase or P) 104*a* and a second terminal 110 connected to a first terminal 112 of the lamp 102. A capacitor CP has a first terminal 114 coupled to the first lamp terminal 112 and a second terminal 116 coupled to a second lamp terminal 118, such that the capacitor CP in the lamp 102 are connected in parallel. The second lamp terminal 118 and the second capacitor terminal 116 are coupled to the second input terminal (Neutral or N) 104*b*.

Figure 3:
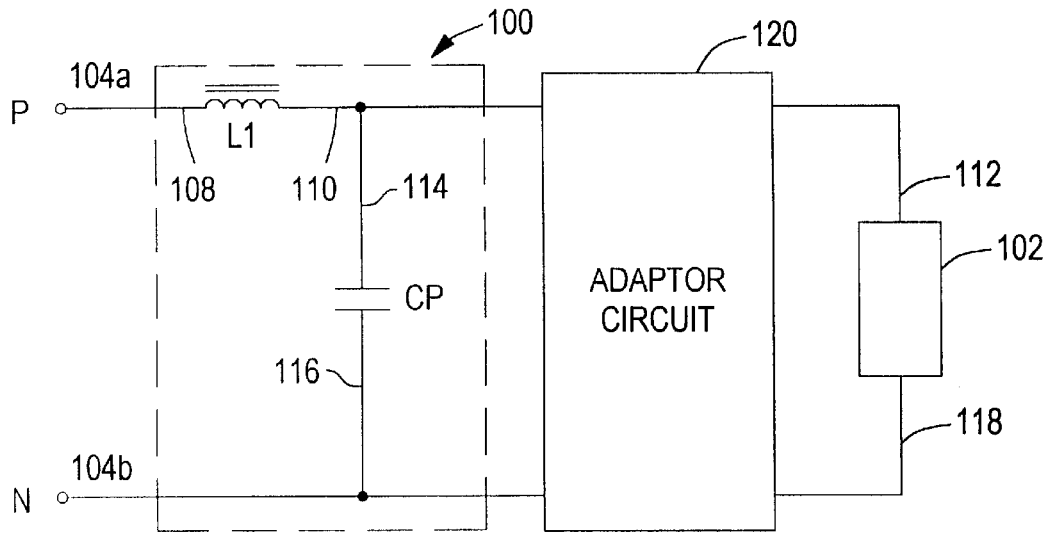
FIG. 3 is a circuit diagram of the ballast circuit of FIG. 1 further including an electronic adaptor.

As shown in FIG. 3, an adaptor circuit 120 can be coupled between the magnetic ballast and the lamp 102 to provide a relatively high frequency AC signal to the lamp for more efficient operation. Exemplary adaptor circuits are disclosed in copending and commonly assigned U.S. patent application Ser. No. 08/753,044, and U.S. Pat. No. 4,682,083 (Alley), which are incorporated herein by reference.

In operation, current flowing through the first inductive element L1 and the parallel capacitor CP resonates in series at a characteristic resonant frequency which is determined by the impedance values of the first inductive element L1, the parallel capacitor CP, and the lamp 102. The series resonance provides a voltage level which is greater than that of the input line voltage for increasing the power available to the lamp 102. In an exemplary embodiment, the impedance values of the first inductor L1 and the parallel capacitor CP are selected for series resonance at about 50 Hertz. Illustrative impedance values for the first inductor L1 and the parallel capacitor CP are 1.5 Henrys and 0.33 microfarads, respectively.

Figure 1:
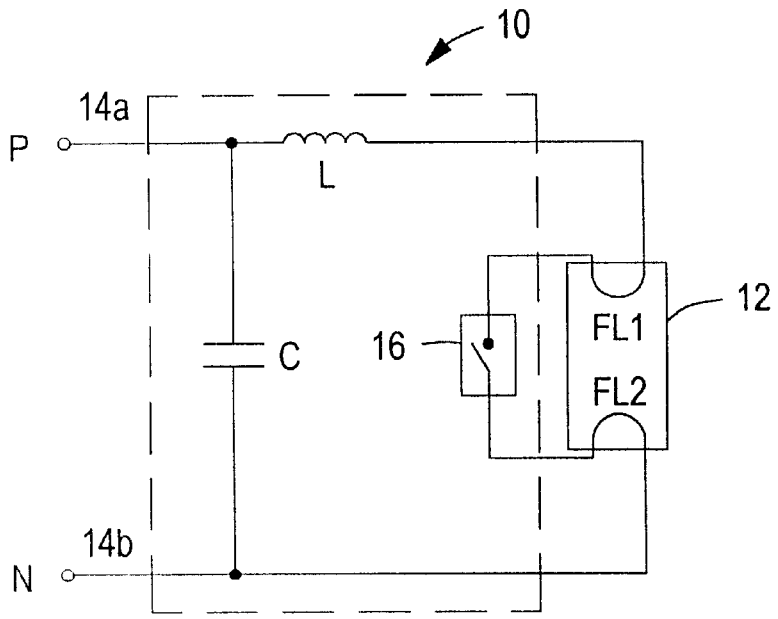
FIG. 1 (PRIOR ART)
FIG. 1 is a circuit diagram of a prior art ballast circuit.

In the exemplary embodiment of FIG. 2, the 230 Volt 50 Hertz input signal is effective to start the lamp without a starter 16 (FIG. 1). In addition, the power dissipation is significantly less than that of a conventional ballast 10. For example, typical values for the prior art ballast of FIG. 1 are 1.5 Henrys for the inductor L and 3.0 microfarads for the capacitor C. In contrast, illustrative values for the components in the ballast of FIG. 2 include 1.5 Henrys for the first inductor L1 and 0.33 microfarads for the parallel capacitor CP. The lower capacitance of capacitor CP, as compared with capacitor C, provides a power reduction of about one order of magnitude over the prior art ballast of FIG. 1.

Figure 4:
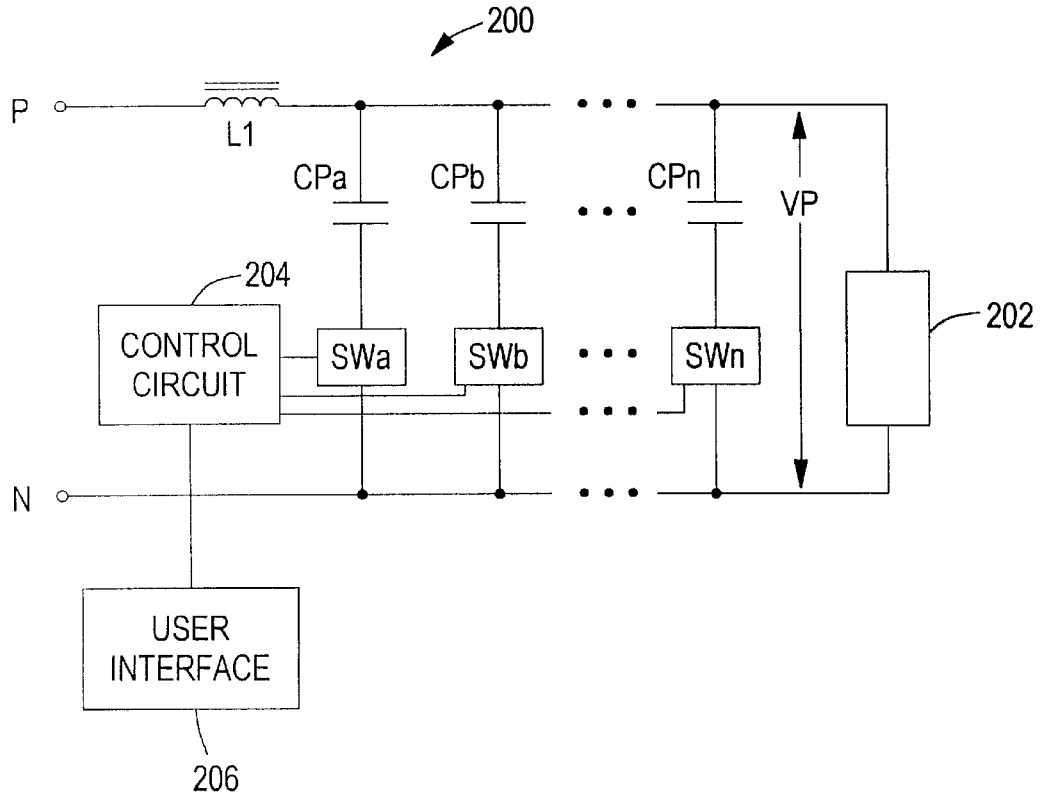
FIG. 4 is a circuit diagram of another embodiment of a ballast circuit in accordance with the present invention.

FIG. 4 shows a ballast circuit 200 which provides a user-selectable power level to a lamp 202. That is, the ballast 200 has a dimming feature which allows the intensity of light emitted by the lamp 202 to be controlled. The ballast includes a first inductive element L1 coupled to the lamp 202 and a plurality of capacitors CPa–n coupled in parallel with the lamp. Coupled in series with each of the capacitors CPa–n is a respective switch SWa–n. The position of each of the switches SW, i.e., open or closed, is independently controlled by a switch control circuit 204. The control circuit 204 is coupled to a user interface 206, such as a dial, which is manually actuable by a user. Alternatively, lamp light intensity can be controlled by other user interface devices including timers, voice recognition systems, computer control systems or other data input mechanisms known to one of ordinary skill in the art.

In operation, the total capacitance provided by the capacitors CP determines the amount of power that is delivered to the lamp 202. Where the input signal, here shown as corresponding to Phase and Neutral, has a fixed frequency, i.e., 50 Hertz, maximum power occurs when the impedance values of the first inductor L1 and the parallel capacitor CP are selected to resonate at this frequency. And while the input signal frequency remains fixed, altering the total capacitance provided by the capacitors CPa–n alters the power at the lamp.

Figure 5:
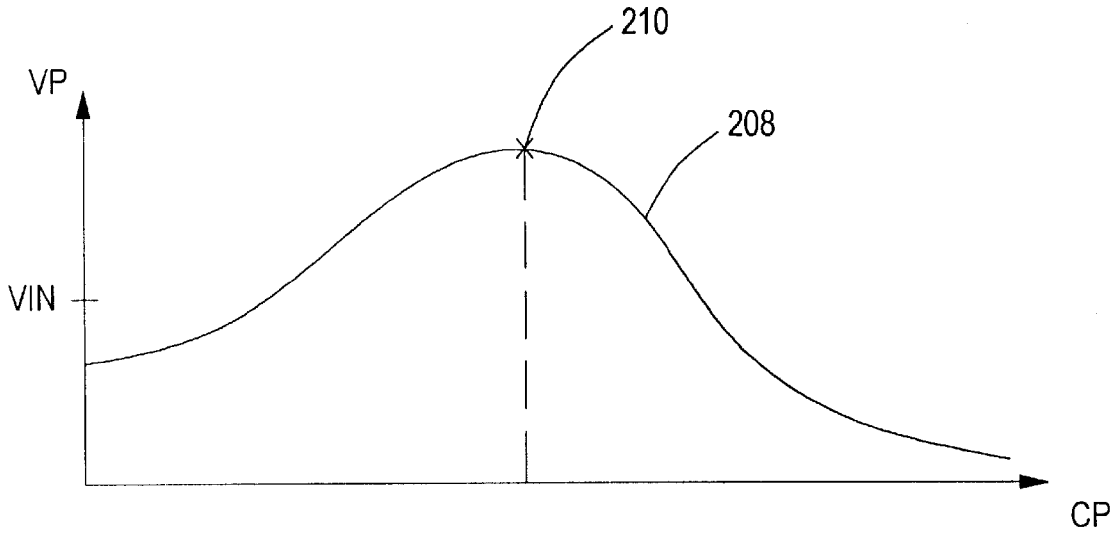
FIG. 5 is a graphical depiction of signal levels corresponding to the ballast circuit of FIG. 4.

As shown in FIG. 5, the voltage VP 208, which corresponds to the voltage across the lamp 202 (and each of the parallel capacitors CPa–n), is determined by the total impedance of the first inductor L1 and the parallel capacitors CPa–n. At 50 Hertz, which corresponds to the frequency of the exemplary input signal, particular impedance values for the first inductor L1 and the parallel capacitors CPa–n provide a peak voltage 210 for the voltage VP. It is understood that a predetermined configuration for the switches SWa–n provides a total capacitance for the parallel capacitors CPa–n which corresponds to the peak VP voltage 210.

Since the impedance of the first inductor L1 is fixed in the illustrated embodiment, the voltage VP can be set to a predetermined value by selecting the total capacitance provided by the parallel capacitors CPa–n. That is, by switching in certain ones of the parallel capacitors CPa–n, a desired power level can be provided to the lamp 202 for selecting an intensity level for the light emitted by the lamp, i.e., the lamp can be dimmed. The user can control the lamp light intensity by actuating the dial 206 which ultimately controls the state of the switches SWa–n to provide a desired light intensity. For example, at maximum power, each of the switches SWa–n is closed. And to decrease the light intensity, i.e., dimming, some of the switches SW transition to an open state to alter the total capacitance provided by the capacitors CPa–n.

Figure 6:
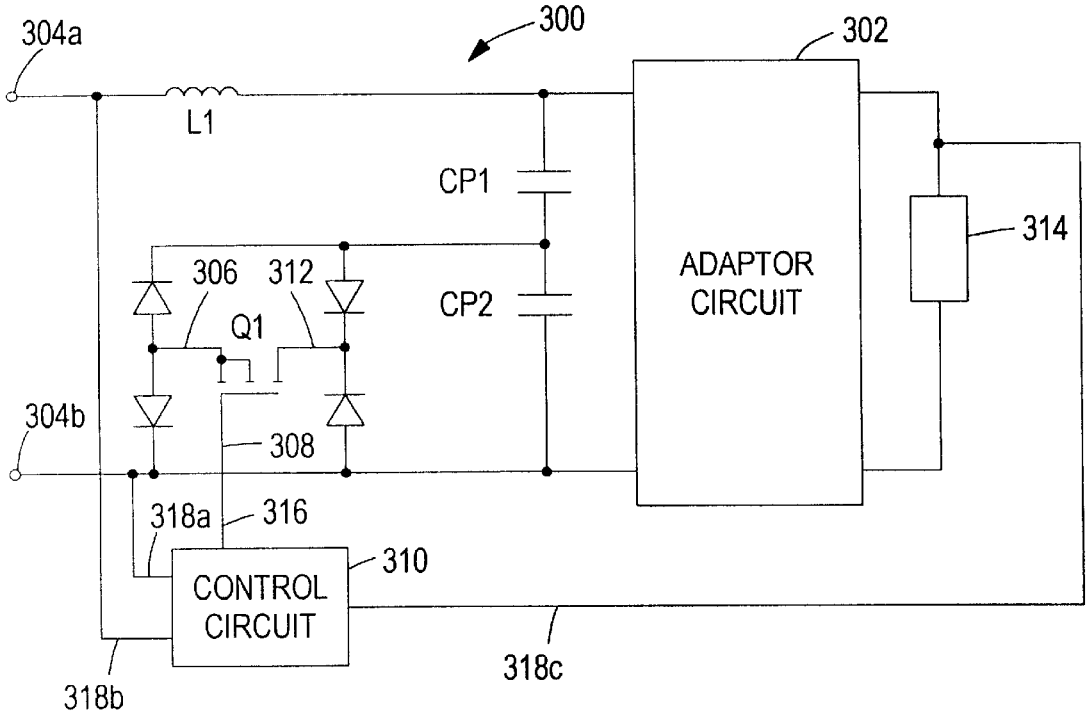
FIG. 6 is a circuit diagram of another embodiment of a ballast circuit in accordance with the present invention.

FIG. 6 shows another embodiment of a ballast circuit 300 having a dimming feature. The ballast includes an inductive element L1 coupled between an optional adaptor circuit 302 and a first input terminal 304*a*. First and second capacitors CP1,CP2 are coupled end to end between the first and second input terminals 304*a,b*. A switching element Q1, shown here as a transistor, is coupled to a diode network formed from diodes D1–4, as shown.

The switching element Q1 has a first terminal 306 coupled to a point between the first and second diodes D1,D2, which are coupled end to end across the second capacitor CP2. A second terminal 308 of the switching element Q1 is coupled to a control circuit 310 and a third terminal 312 of the switching element is coupled to a point between the third and fourth diodes D3,D4, which are also coupled end to end across the second capacitor CP2. The control circuit 310 is effective to control the conduction state of the switching element Q1.

In operation, the input signal, a 230 volt 50 Hertz signal for example, is received at the first and second input terminals 304*a,b* and energizes the circuit elements including the lamp 314 which emits visible light. The control circuit 310 controls the conduction state of the switching element Q1 via a control signal 316 so as to provide a desired intensity level for the light. Light intensity is controlled by altering the total capacitance provided by the first and second capacitors CP1,CP2. When the switching element Q1 is conductive or ON, the second capacitor CP2 is effectively shorted so that impedance provided by the second capacitor is removed from the circuit. And when the switching element is non-conductive or OFF, the total capacitance includes the capacitance of the second capacitor CP2. In one embodiment, maximum power, i.e., highest lamp light intensity, occurs when the switching element is ON.

The control circuit 310 monitors the voltage to the lamp 314 via feedback signals 318*a,b,c*, which monitor the input signal and load voltage, and maintains a predetermined lamp power level by controlling the conduction state of the switching element Q1. The control circuit 310 controls the duty cycle of the switching element Q1 which determines the total capacitance provided by the first and second capacitors CP1,CP2. It is understood that the frequency of the control signal 316 need only be greater than the frequency of the input signal and can be orders of magnitude greater.

In other embodiments, further switching elements and control circuits can control further capacitors. For example, a plurality of capacitors of varying impedance can be coupled in the circuit for added resolution of the load voltage.

Figure 7:
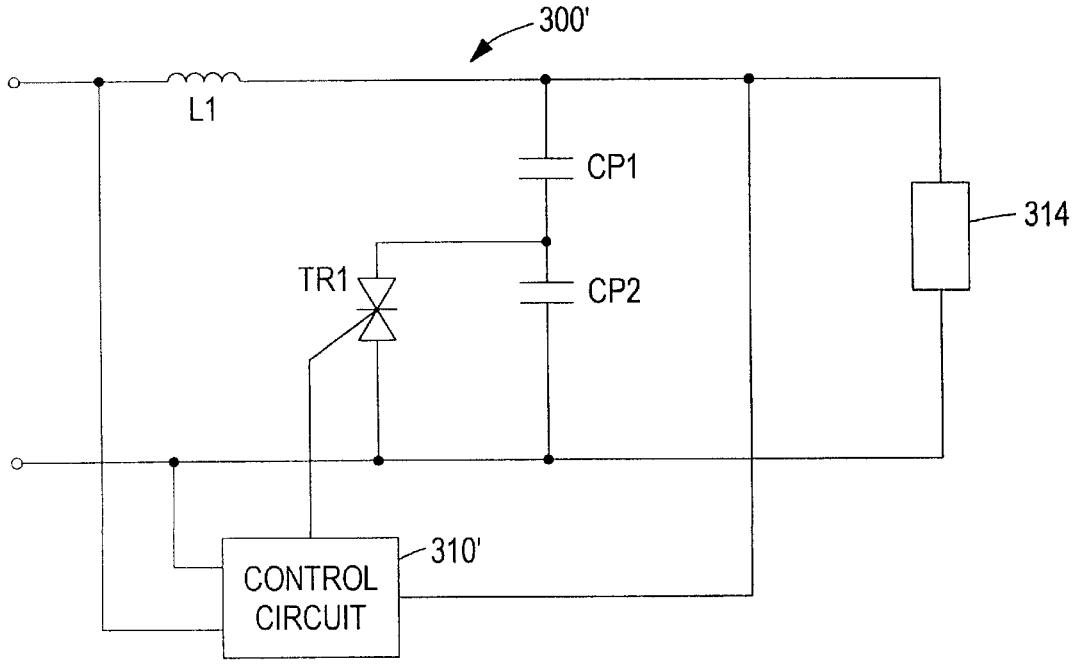
FIG. 7 is a circuit diagram of an alternative embodiment of the circuit of FIG. 6.

FIG. 7 shows an alternative embodiment 300' of the ballast circuit 300 of FIG. 6, wherein like reference designations indicate like elements. The ballast circuit 300' includes a triac TR1 coupled to a point between the first and second capacitors CP1,CP2. The triac TR1 is coupled to a control circuit 310' which controls the conduction state of the triac. The conduction state of the triac TR1 determines the total capacitance provided by the first and second capacitors CP1,CP2. The control circuit 310' is effective to provide a selected lamp light intensity and/or a desired load voltage level.

Figure 8:
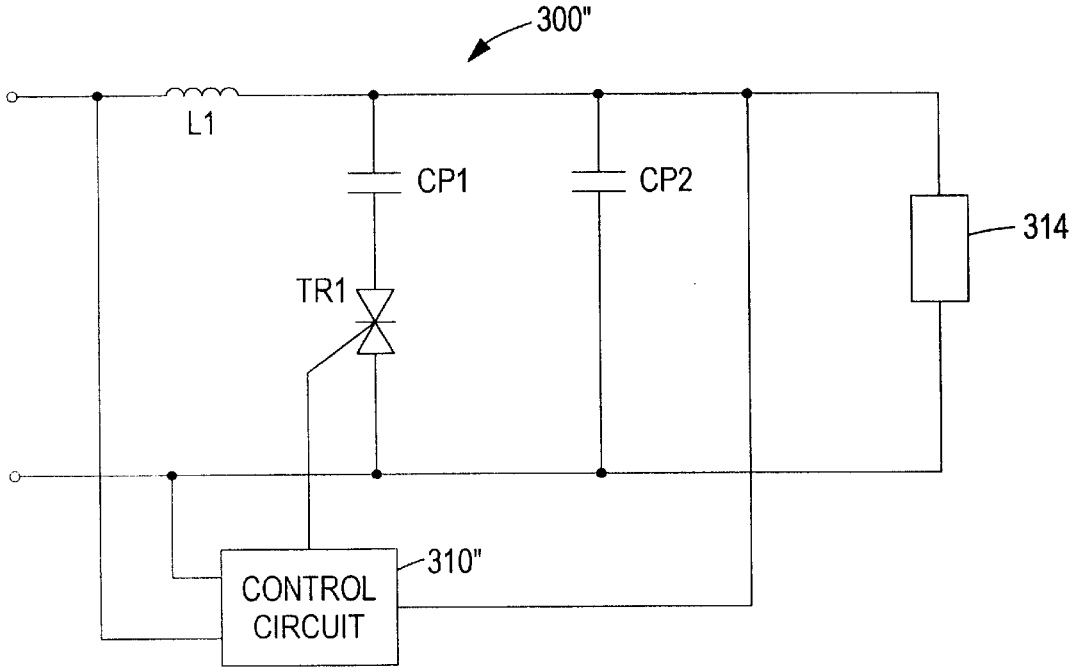
FIG. 8 is a circuit diagram of a further alternative embodiment of the circuit of FIG. 6.

In FIG. 8, a ballast circuit 300" includes first and second capacitors CP1,CP2 each coupled in parallel with the lamp 314. A triac TR1 is coupled in series with the first capacitor CP1 for controlling whether the impedance associated with the first capacitor is present in the circuit. That is, when the triac TR1 is conductive the impedance of the first capacitor CP1 forms a part of the total capacitance provided by the first and second capacitors CP1,CP2. The control circuit 310" controls the conduction state of the triac TR1 so as to provide a selected level of light intensity and/or load voltage.

Figure 9:
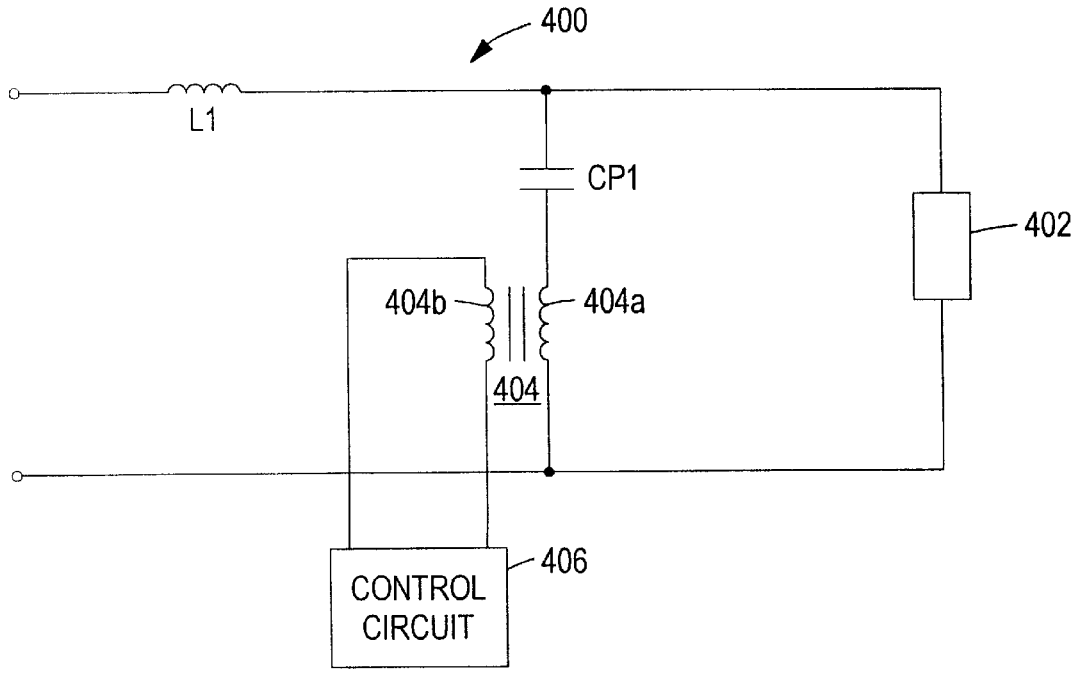
FIG. 9 is a circuit diagram of a further embodiment of a ballast circuit in accordance with the present invention.

FIG. 9 shows a ballast circuit 400 having a first inductive element L1 coupled to a lamp 402. A first capacitor CP1 and a first winding 404*a* of a transformer 404 are coupled in series such that the series-coupled first capacitor CP1 and first winding 404*a* are coupled in parallel with the lamp 402. A second winding 404*b* of the transformer is coupled to a control circuit 406.

In operation, the control circuit 406 controls the impedance of the first winding 404*a* of the transformer. That is, the control circuit 406, provides a signal to the second winding 404*b* that is effective to cancel a selected amount of flux generated by the first winding 404*a* of the transformer. When the flux is completely canceled, the first winding 404*a* provides a small DC resistance to the circuit. The control circuit 406 can provide a signal to the second winding 404*b* that cancels a predetermined portion of the flux generated by the first winding. The amount of flux that is canceled can vary from substantially all to substantially none. Thus, the control circuit 406 provides a selected impedance for the first winding 404*a* so as to select a desired power to the lamp 402 by controlling the resonant characteristics of the circuit. In one embodiment where the AC input signal has a predetermined amplitude and frequency, 230 volts at 50 Hertz for example, the power to the lamp 402 is readily controlled by selecting a desired impedance value for the first winding 404*a* by canceling a desired amount of flux.

Figure 10:
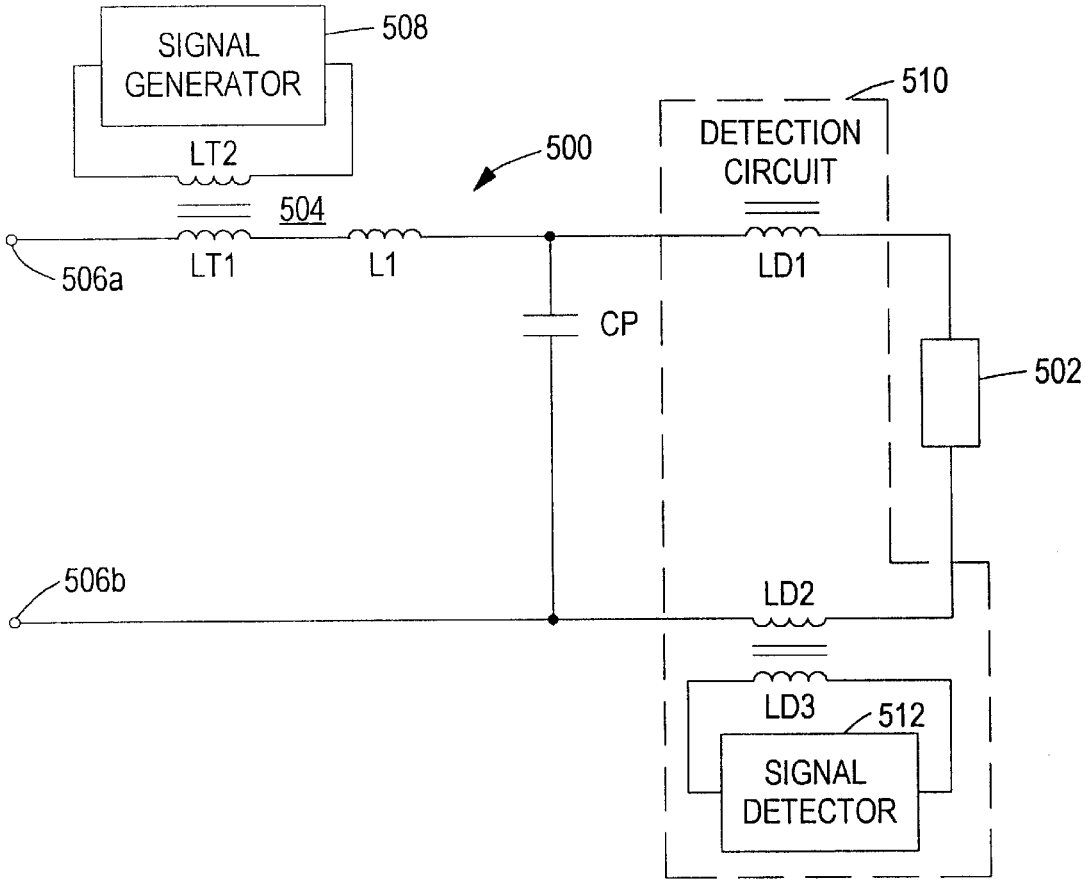
FIG. 10 is a circuit diagram of yet another embodiment of a ballast circuit in accordance with the present invention.

FIG. 10 shows an exemplary embodiment of a ballast circuit 500 including a first inductive element L1 and a parallel capacitor CP coupled to a lamp 502. A first transformer 504 includes a first winding LT1 coupled between a first input terminal 506*a* and the first inductive element L1 and a second winding LT2 coupled to a signal generator 508. A detection circuit 510 includes first, second, and third inductive detection elements LD1,LD2,LD3, which are inductively coupled, and a signal detector 512. The first and second detection elements LD1,LD2 are coupled to opposite ends of the lamp 502 and the third detection element LD3 is coupled to a signal detector 512.

In operation, an input signal having a given amplitude and frequency, 230 volts and 50 Hertz for example, is provided to the input terminals 506*a,b* of the circuit. The signal generator 508, under the control of a user, impresses a data signal having a predetermined amplitude and frequency upon the second transformer winding LT2 which induces a corresponding voltage on the first transformer winding LT1. The data signal propagates to the circuit elements which generates a series resonance between the first inductive element L1 and the parallel capacitor CP. This resonant signal generates a corresponding signal that induces a voltage on the third detection element LD3 which corresponds to a flux differential between the first and second detection elements LD1,LD2. The voltage appearing on the third detection element LD3 is detected by the signal detector 512.

Figure 11:
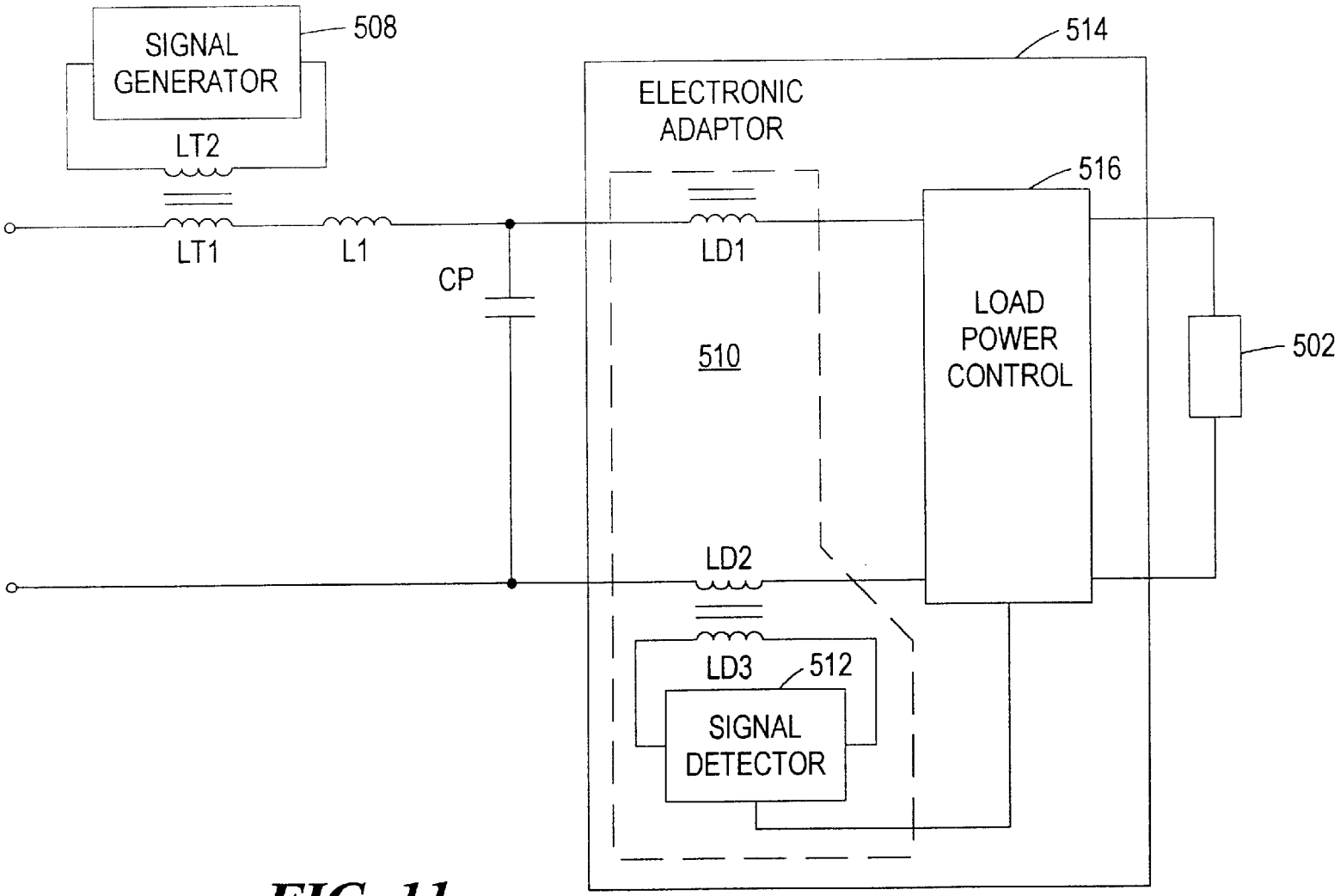
FIG. 11 is a circuit diagram of the circuit of FIG. 10 further including an electronic adaptor circuit.

FIG. 11 shows a ballast circuit having an electronic adapter circuit 514 which includes the detection circuit 510 of FIG. 10. The detection circuit 510 is coupled to a load power control circuit 516 for controlling the power delivered to the lamp 502 based upon the information provided by the signal detector 512. Thus, a user can vary the light intensity of the lamp by controlling the signal introduced to the circuit by the signal generator 508.

It is understood that the characteristics of the data signal produced by the signal generator 508 can vary widely, provided that the signal appears on the transformer first winding LT1. An exemplary data signal has a frequency of about 1k Hertz and an amplitude of about 1 volt. The data signal can also be modulated, such as by frequency-shift keying for example. It is further understood that the data signal can be provided in pulses of various durations for detection by the detection circuit.

Providing a data signal by means of introducing a relatively low frequency series current into the circuit is to be contrasted with conventional circuits that generate a relatively high frequency signal across the input terminals of the circuit. Such high frequency signals dissipate relatively quickly and may conflict with FCC regulations.

It is understood that the series power line communication circuit disclosed herein is not limited to dimming ballast circuits, but rather has a wide range of applications where it is desirable to send information from one location in a circuit to another.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A ballast circuit for energizing a lamp, comprising:

first and second input terminals for receiving an AC input signal which energizes the ballast circuit;

an inductive element coupled to the first input terminal;

a plurality of capacitive elements coupled in parallel with the lamp, each of the capacitive elements having first and second terminals, said first terminal being coupled to the inductive element, wherein a current flowing through the capacitive element and the inductive element resonates in series, a switch connected to said capacitive elements and configured to selectively couple different selected ones of said capacitive elements into said ballast circuit to selectively vary the total capacitance of said ballast circuit.

2. The ballast circuit according to claim 1, further including an electronic adaptor circuit coupled in parallel with the capacitive element.

3. A ballast circuit according to claim 1, wherein the capacitive elements include a plurality of capacitors.

4. A ballast circuit according to claim 3, wherein the switch includes a switching element coupled in series with a first one of the plurality of capacitors.

5. A ballast circuit according to claim 1, further including a control circuit coupled to the switch for controlling a state of the switch.

6. The ballast circuit according to claim 5, further including a user interface coupled to the control circuit for allowing a user to control the switch and select an intensity level for light emitted by the lamp.

7. A ballast circuit for energizing a lamp, comprising:

first and second input terminals for receiving an AC input signal which energizes the ballast circuit;

an inductive element coupled to the first input terminal;

a capacitive element coupled in parallel with the lamp, the capacitive element having a first and second terminals, said first terminal being coupled to the inductive element;

a control circuit coupled to a switch for controlling a state of the switch;

a plurality of switches each of which is coupled in series with a respective one of a plurality of capacitors and connected to the control circuit;

wherein a current flowing through the capacitive element and the inductive element resonates in series.

8. The ballast circuit according to claim 7, wherein a total capacitance provided by respective ones of the plurality of capacitors, which are coupled to respective switches set to a position which corresponds to a short circuit, determines a voltage level at the lamp.

9. A ballast circuit for energizing a lamp, comprising:

first and second input terminals for receiving an AC input signal which energizes the ballast circuit;

an inductive element coupled to the first input terminal;

a capacitive element coupled in parallel with the lamp, the capacitive element having a first and second terminals, said first terminal being coupled to the inductive element, the capacitive element having first and second capacitors coupled end to end, and a switching element coupled to the first capacitor for selectively shorting the first capacitor, wherein a current flowing through the capacitive element and the inductive element resonates in series.

10. The ballast circuit according to claim 9, further including a control circuit for controlling a duty cycle of the switching element.

11. The ballast circuit according to claim 9, wherein the switching element comprises a transistor.

12. The ballast circuit according to claim 9, wherein the switching element comprises a triac.

13. A ballast circuit for energizing a lamp, comprising:

first and second input terminals for receiving an AC input signal which energizes the ballast circuit;

an inductive element coupled to the first input terminal;

a capacitive element coupled in parallel with the lamp, the capacitive element having a first and second terminals, said first terminal being coupled to the inductive element, the capacitive element including first and second capacitors coupled in parallel and a switching element coupled in series with the first capacitor;

wherein a current flowing through the capacitive element and the inductive element resonates in series.

14. The ballast circuit according to claim 1, further including a transformer having a first winding coupled in series with the capacitive element.

15. A ballast circuit for energizing a lamp, comprising:

first and second input terminals for receiving an AC input signal which energizes the ballast circuit;

an inductive element coupled to the first input terminal;

a capacitive element coupled in parallel with the lamp, the capacitive element having first and second terminals, said first terminal being coupled to the inductive element, a transformer having a first winding coupled in series with the capacitive element, a control circuit coupled to the second winding of the transformer for canceling a predetermined level of flux generated by the first winding, wherein a current flowing through the capacitive element and the inductive element resonates in series.

16. A ballast circuit for energizing a lamp, comprising:

first and second input terminals for receiving an AC input signal which energizes the ballast circuit;

an inductive element coupled to the first input terminal;

a capacitive element coupled in parallel with the lamp, the capacitive element having first and second terminals, said first terminal being coupled to the inductive element, a transformer having a first winding coupled in series with the inductive element and having a second winding, and inductively coupled first and second inductive detection elements which are coupled to opposite ends of the lamp.

17. The ballast circuit according to claim 16, wherein the second winding of the first transformer is coupled to a signal generator.

18. The ballast circuit according to claim 17, further including a third inductive detection element, which is inductively coupled to the second inductive element, coupled to a signal detector for detecting a signal from the signal generator.

19. The ballast circuit according to claim 18, further including an electronic adaptor circuit coupled to the lamp.

20. The ballast circuit according to claim 19, wherein the first, second, and third detection elements and the signal detector are located within the adaptor circuit which controls the lamp light intensity based upon the signal detected by the signal detector.

21. A circuit for energizing a load, comprising:

first and second input terminals;

a transformer having a first winding coupled to the first input terminal and a second winding coupled to a signal generator;

an inductive element coupled to the first winding;

first and second inductive detection elements coupled to opposite ends of the load; and a third inductive detection element coupled to a signal detector, the third detection element being inductively coupled to the first detection element, wherein the signal detector detects a signal from the signal generator.

22. The circuit according to claim 21, wherein the signal generator generates a signal having a frequency between about 1 kiloHertz and about 2 kiloHertz.

23. The circuit according to claim 21, wherein the signal generator generates a signal having an amplitude between about 1 volt.

* * * * *